US009478404B2

(12) United States Patent
Thomson et al.

(10) Patent No.: US 9,478,404 B2
(45) Date of Patent: Oct. 25, 2016

(54) HIGH RESOLUTION TIME-OF-FLIGHT MASS SPECTROMETER

(71) Applicant: DH Technologies Development Pte. Ltd., Singapore (SG)

(72) Inventors: Bruce Thomson, Toronto (CA); Robert E. Haufler, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/369,912

(22) PCT Filed: Dec. 4, 2012

(86) PCT No.: PCT/IB2012/002597
§ 371 (c)(1),
(2) Date: Jun. 30, 2014

(87) PCT Pub. No.: WO2013/098611
PCT Pub. Date: Jul. 4, 2013

(65) Prior Publication Data

US 2014/0339419 A1 Nov. 20, 2014

Related U.S. Application Data

(60) Provisional application No. 61/581,935, filed on Dec. 30, 2011.

(51) Int. Cl.
*H01J 49/06* (2006.01)
*H01J 49/40* (2006.01)
*H01J 49/00* (2006.01)

(52) U.S. Cl.
CPC ..... *H01J 49/067* (2013.01); *H01J 49/0031* (2013.01); *H01J 49/40* (2013.01); *H01J 49/401* (2013.01)

(58) Field of Classification Search
USPC ..... 250/281, 282, 288, 287
See application file for complete search history.

(56) References Cited

U.S. PATENT DOCUMENTS

| | | | | |
|---|---|---|---|---|
| 7,301,145 | B2 * | 11/2007 | Holle | H01J 49/0031 250/287 |
| 7,531,793 | B2 | 5/2009 | Satoh et al. | |
| 2007/0080290 | A1 | 4/2007 | Parker et al. | |
| 2009/0057577 | A1 * | 3/2009 | Parker | B82Y 10/00 250/492.23 |
| 2010/0237233 | A1 * | 9/2010 | Covey | H01J 49/06 250/282 |
| 2011/0114851 | A1 * | 5/2011 | Purser | G21K 5/04 250/396 R |
| 2012/0138785 | A1 * | 6/2012 | Makarov | H01J 49/406 250/282 |

FOREIGN PATENT DOCUMENTS

| | | |
|---|---|---|
| WO | 2008-098081 | 8/2008 |
| WO | 2011-101607 | 8/2011 |

OTHER PUBLICATIONS

International Search Report from International Patent Application No. PCT/IB2012/002597, Apr. 29, 2013.

* cited by examiner

*Primary Examiner* — Phillip A Johnston
*Assistant Examiner* — Hsien Tsai

(57) ABSTRACT

Mass spectrometers and related methods of making and using the same are disclosed herein that generally involve positioning a blocking or masking element in the path of an ion beam passing through the mass spectrometer so as to selectively block at least a portion of the ions in the ion beam from entering an accelerator. Mass spectrometers and related methods are also disclosed in which an ion beam passing through the mass spectrometer is deflected or otherwise aimed so as to approach a TOF axis of an accelerator at a non-zero angle.

7 Claims, 4 Drawing Sheets

HIGH RESOLUTION TIME-OF-FLIGHT MASS SPECTROMETER

RELATED APPLICATION

This application claims priority to U.S. provisional application No. 61/581,935, filed Dec. 30, 2011, which is incorporated herein by reference in its entirety.

FIELD

The applicant's teachings relate to the field of mass spectrometry. In particular, the applicant's teachings relate to high resolution time-of-flight mass spectrometers and methods of making and using the same.

INTRODUCTION

A number of time-of-flight ("TOF") mass spectrometers exist, however there exists a need for TOF mass spectrometers having improved resolution.

SUMMARY

In one aspect of at least one embodiment of the applicant's teachings, a mass spectrometer is provided that can comprise an accelerator having an inlet aperture through which an ion beam can be directed, and a masking element disposed upstream from the accelerator and configured to selectively block at least a portion of the ion beam from entering the accelerator.

The portion of the ion beam can be or can comprise a central portion of the ion beam. The portion of the ion beam can be or can comprise only one edge of the ion beam.

Related aspects of at least one embodiment of the applicant's teachings provide a mass spectrometer, e.g., as described above, in which the masking element is disposed within the inlet aperture of the accelerator.

Related aspects of at least one embodiment of the applicant's teachings provide a mass spectrometer, e.g., as described above, in which the masking element is disposed within beam-shaping optics disposed upstream from the accelerator.

Related aspects of at least one embodiment of the applicant's teachings provide a mass spectrometer, e.g., as described above, in which the portion of the ion beam comprises a portion of the ion beam located closest to an exit of said accelerator.

Related aspects of at least one embodiment of the applicant's teachings provide a mass spectrometer, e.g., as described above, in which the masking element comprises a wire electrode.

In another aspect of at least one embodiment of the applicant's teachings, a method of directing an ion beam through a mass spectrometer is provided that can comprise directing the ion beam through a masking element disposed upstream of an accelerator, so as to selectively block at least a portion of the ion beam from entering the accelerator. The portion of the ion beam can be or can comprise a central portion of the ion beam. The portion of the ion beam can be only one edge of the ion beam.

Related aspects of at least one embodiment of the applicant's teachings provide a method, e.g., as described above, in which the portion of the beam is only one edge of the ion beam and said only one edge is blocked by an edge of an entrance slit of the accelerator.

In another aspect of at least one embodiment of the applicant's teachings, a mass spectrometer is provided that can comprise an ion optical element configured to direct an ion beam passing therethrough towards a TOF axis of an accelerator at a non-zero angle.

Related aspects of at least one embodiment of the applicant's teachings provide a mass spectrometer, e.g., as described above, in which the ion optical element deflects the ion beam at the non-zero angle.

Related aspects of at least one embodiment of the applicant's teachings provide a mass spectrometer, e.g., as described above, in which the ion optical element is mechanically coupled to the accelerator at the non-zero angle.

In another aspect of at least one embodiment of the applicant's teachings, a method of directing an ion beam through a mass spectrometer is provided that can comprise directing the beam towards a TOF axis of an accelerator of the mass spectrometer at a non-zero angle.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DESCRIPTION OF VARIOUS EMBODIMENTS

Certain exemplary embodiments will now be described to provide an overall understanding of the principles of the structure, function, manufacture, and use of the methods, systems, and devices disclosed herein. One or more examples of these embodiments are illustrated in the accompanying drawings. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Mass spectrometers and related methods of making and using the same are disclosed herein that generally involve positioning a blocking or masking element in the path of an ion beam passing through the mass spectrometer so as to selectively block at least a portion of the ions in the ion beam from entering an accelerator. Mass spectrometers and related methods are also disclosed in which an ion beam passing through the mass spectrometer is deflected or otherwise aimed so as to approach a TOF axis of an accelerator at a non-zero angle.

Figure 1:
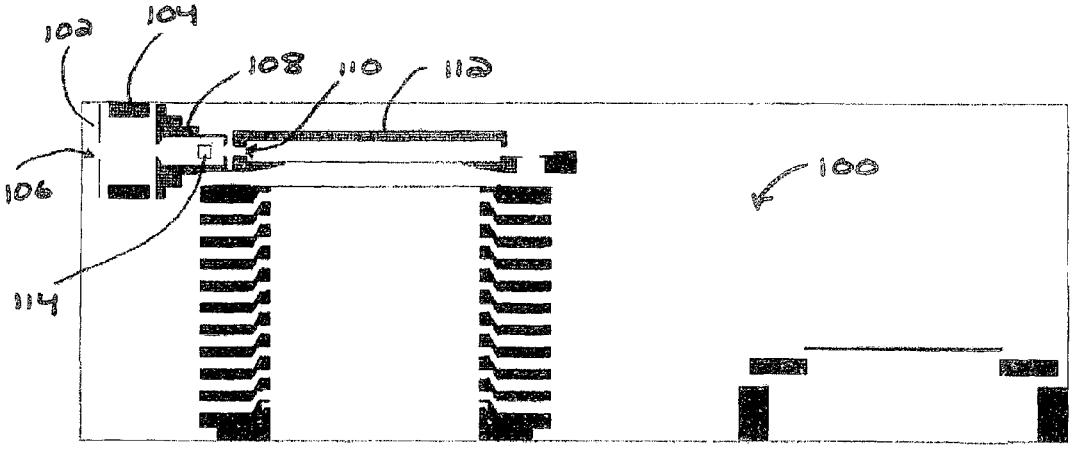
FIG. 1 is a schematic cross-sectional view of a portion of one exemplary embodiment of a mass spectrometer according to the applicant's teachings in which a masking element is disposed within a beam-shaping optic.

FIG. 1 is schematic illustration of a portion of one exemplary embodiment of a mass spectrometer 100 according to the applicant's teachings. As shown, the mass spectrometer 100 can comprise a collision cell 102 coupled to a cylindrical lens 104 via an exit aperture 106. The cylindrical lens 104 can in turn be coupled to downstream beam-shaping optics 108. An exit end of the beam-shaping optics 108 can be coupled to the inlet aperture 110 of an accelerator 112.

The mass spectrometer 100 can also comprise a blocking or masking element 114 which can be positioned in the path of the ion beam to selectively block a portion of the beam from continuing to traverse through the mass spectrometer 100. In some embodiments, the portion of the beam blocked by the masking element 114 can be a substantially circular central portion of the beam's lateral cross-section.

Figure 2:
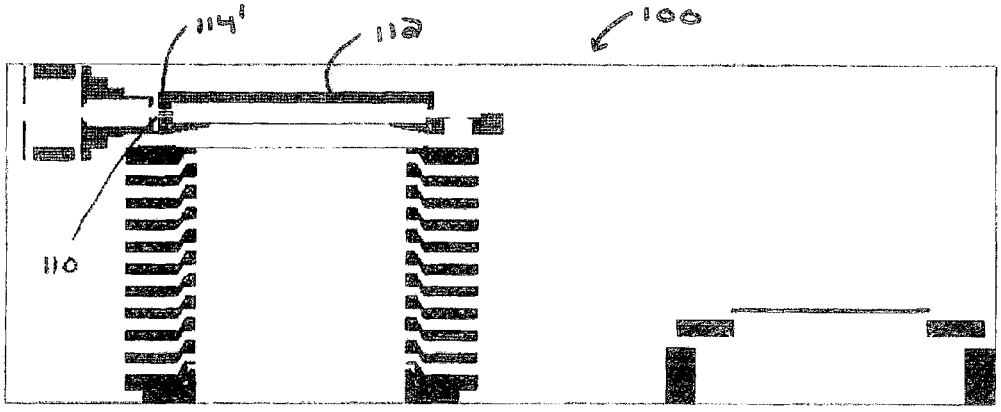
FIG. 2 is a schematic cross-sectional view of a portion of one exemplary embodiment of a mass spectrometer according to the applicant's teachings in which a masking element is disposed within an accelerator inlet.

The masking element 114 can be positioned at any of a variety of locations within the mass spectrometer 100. In some embodiments, the masking element 114 can be positioned between the exit aperture 106 of the collision cell 102 and the inlet aperture 110 of the accelerator 112. For example, in the embodiment illustrated in FIG. 1, the masking element 114 can be positioned within the beam-shaping optics 108. Alternatively, or in addition, a masking element 114' can be positioned in or at the inlet aperture 110 of the accelerator 112, for example as shown in FIG. 2. In some embodiments, the masking element 114 can be the last component encountered by the ion beam before it enters the accelerator 112. Any of a variety of structures can be used to form the masking element 114, such as a wire or needle electrode.

Figure 3:
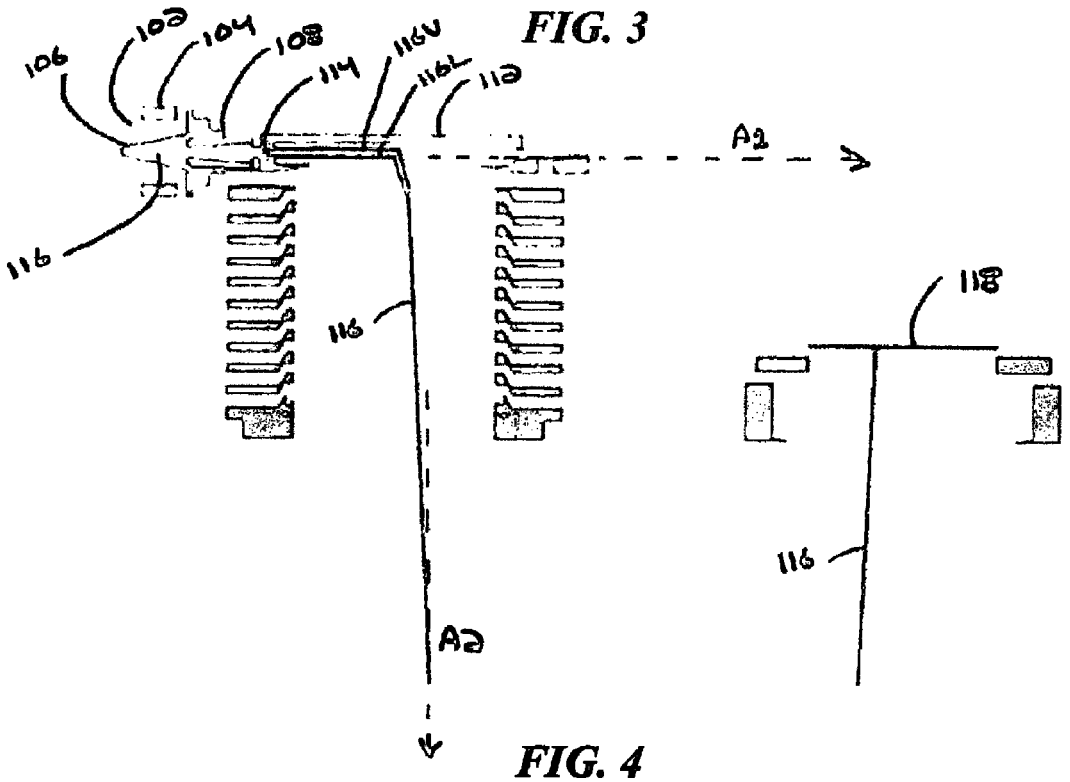
FIG. 3 is a schematic cross-sectional view of the mass spectrometer of FIG. 2, where an ion beam is directed therethrough.
Figure 4:
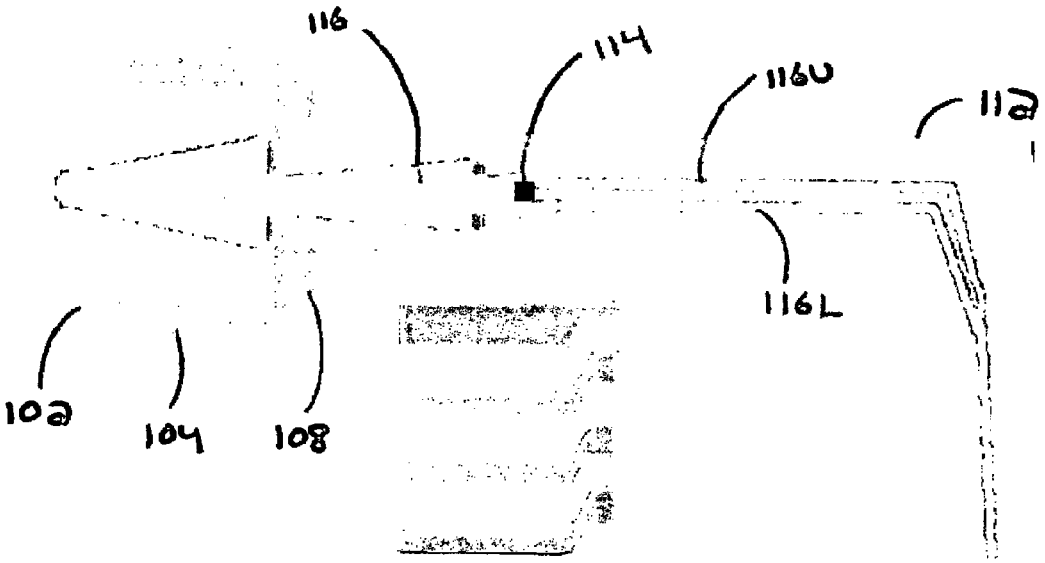
FIG. 4 is an enlarged view of the masking element and ion beam of FIG. 3.

In use, as shown in FIGS. 3-4, an ion beam 116 can be directed through the exit aperture 106 of the collision cell 102 along a beam axis A1 and into the cylindrical lens 104 and beam-shaping optics 108. The ion beam 116 can then enter the accelerator 112 where, in the case of an orthogonal TOF system, the beam 116 can be redirected by an angle of about 90 degrees such that it is substantially coaxial with a TOF axis A2. The beam 116 can then travel out of the field of view of FIG. 3, where it can be reflected and redirected into a detector 118.

Figure 5:
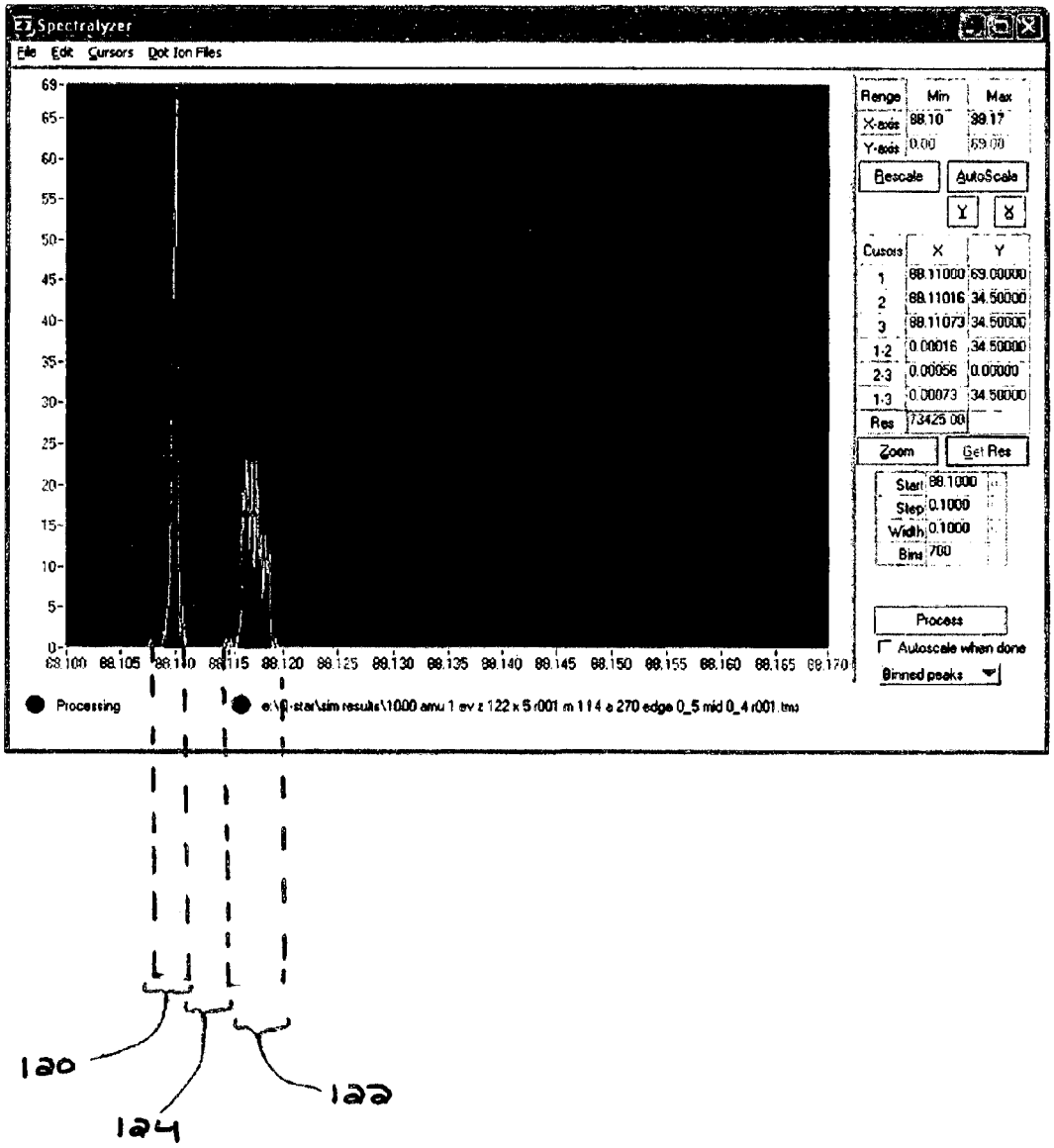
FIG. 5 is a simulated output spectra obtained when the mass spectrometer of FIG. 2 is used to analyze a sample.

As can be seen from FIGS. 3-4, selectively masking a central portion of the ion beam 116 can produce a beam that in cross-section can comprise distinct upper and lower ion bands 116U, 116L. In other words, the ion beam 116 can split around the masking element 114 into upper and lower ion bands 116U, 116L. This is also illustrated in the simulated output spectra of FIG. 5, in which defined peaks 120, 122 are observed in ion bands above and below the masked region, whereas substantially no ions are detected within the masked region 124. The high resolution peak 120 can result from ions in the upper band having a velocity along the TOF axis A2 that directs them away from the mirror end of the TOF. The low resolution peak 122 can result from ions in the lower band having a velocity along the TOF axis A2 that directs them towards the mirror. It will be appreciated that eliminating all ions having a velocity that directs them towards the mirror can produce a better resolution.

Figure 6:
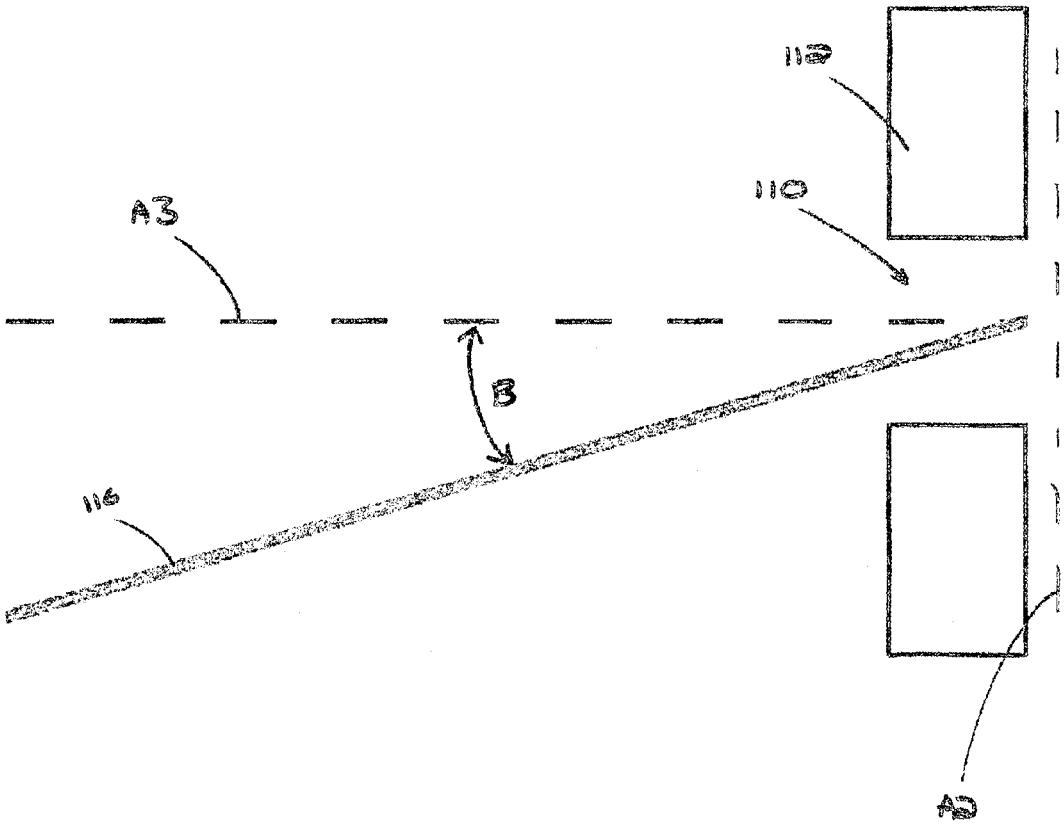
FIG. 6 is a schematic cross-sectional view of a portion of one exemplary embodiment of a mass spectrometer according to the applicant's teachings in which an ion beam is configured to enter an accelerator at a non-zero angle relative to a central longitudinal axis of the accelerator inlet.

Accordingly, as shown in FIG. 6, the ion beam 116 can optionally be aligned such that it enters the inlet aperture 110 of the accelerator 112 at a non-zero angle B relative to the central longitudinal axis A3 of the inlet 110. This can be accomplished, for example, by deflecting the beam away from the central longitudinal axis of the component preceding the accelerator 112, or by configuring the mechanical coupling between said component and the accelerator 112 such that the two meet at a non-zero angle or are misaligned with one another (e.g., such that a central longitudinal axis of the component preceding the accelerator is not collinear with the central longitudinal axis A3 of the accelerator inlet 110). In operation, this can cause all ions to be moving in the same direction relative to the TOF axis A2 (e.g., positive or negative). In other words, as shown for example in FIG. 6, all ions entering the accelerator 112 can have an upward trajectory relative to the TOF axis A2, as opposed to existing systems in which some of the ions entering the accelerator 112 have a downward trajectory and others have an upward trajectory.

Without being limited to any particular theory of operation, it is believed that blocking at least a portion of the ion beam can reduce, or eliminate, "problem" ions. In particular, the ions that make up an ion beam fall into both velocity and position distributions. Around the middle portion of the beam where ion velocity is relatively low, there can be confusion as to whether the ions are moving up or down. Around the outer portions of the beam, however, where the ion velocity is relatively high, it can be easier to discern whether the ions are moving up or down. Accordingly, a means of increasing system resolution can be to block the problem ions in the center of the beam from entering the accelerator.

It is further believed that two classes of ions can degrade the quality of the mass peaks in output spectra of a mass spectrometer. The first class are those ions that share location but have different velocity (e.g., the ion turn around time problem). Static fields cannot correct this problem, but if these ions can be removed, the peak shape can be improved. The second class are those ions that are far from the mass analyzer resolving "sweet spot." The correction provided by most analyzer designs is not symmetric, such that ions that are close to the exit of the accelerator are not corrected as well as ions far from the exit. These ions can cause tailing to high mass in the peaks. Elimination of the ions close to the exit of the accelerator can thus improve the peak shape. By elimination of either or both of these classes of ions, the mass peak shape can be improved which can improve the mass resolution.

In orthogonal TOF, one can view the starting point of the ions as the collision cell exit lens, which is a point source. As the ions are accelerated away from the collision cell to the accelerator, a correlation develops between position along the TOF axis and velocity along the TOF axis (with the TOF axis being an axis which is parallel to the acceleration vector in the accelerator and the ion mirror). The velocity along the TOF axis can result from the thermal kinetic energy of the ions when they exit the collision cell. This correlation can be helpful in minimizing the first class of ions described above (those that share location, but not velocity). In the beam centerline, there remains a possibility that there are ions of the first class. If this middle region is eliminated by a masking element as disclosed above, a substantial portion of the ions that share location but not velocity can be removed.

By creating this correlation, the width of the ion beam can expand the dimension of the beam extending along the TOF axis can increase. As the ion beam width increases, the analyzer can be capable of correcting for this increase. Spread in the dimension of the beam extending along the TOF axis becomes spread in kinetic energy, but the ions with the longer distance to travel in the accelerator become those with the higher velocity, thus this can be again, a helpful correlation. As the beam becomes wider, the asymmetry of the analyzer correction can become more important, and the tails on the peaks can become a larger component of the mass peaks. This perturbation can be corrected for by trimming the beam. The part of the beam that is closest to the exit of the accelerator can be a bigger contributor to the tails, so trimming only this part of the beam can be sufficient. Another alternative can be to direct the beam into the accelerator off-center, e.g., as described above, to make the correction more symmetric and to eliminate or minimize the tailing.

Even allowing the correlation to develop, a finite-diameter beam that enters the accelerator can still have a center region that contains ions moving in both directions. This can still lead to a limitation in resolution due to the turn-around time. Removing or blocking the center part of the beam as described above before the beam enters the accelerator can remove a population of ions that do not have an optimum position-velocity correlation. Some loss of sensitivity can be experienced when part of the beam is blocked, but the improvement in resolution can be significant.

Additionally, the ions close to the accelerator exit can be likewise removed by blocking, or by directing the beam off-center. For example, ions that would otherwise be closest to the accelerator can be removed from the beam by blocking or masking only one edge of the beam using a blocker located in the ion optics after the collision cell, or in the entrance to the accelerator as described previously. Alternatively, the ions on one edge of the beam can be blocked by appropriately locating the entrance aperture, which is typically a slit, so that the center of the slit is not coaxial with the beam center, but is located so that the edge of the beam that will end up closest to the exit from the accelerator is removed or clipped by the edge of the slit. This can permit asymmetrically trimming or clipping the beam to remove ions that are located closer to, or directed toward, the exit of the accelerator. It will be appreciated that, if focusing optics that result in ions passing through a focal point before entering the accelerator are used, the blocking element can be disposed before the focal point but on the opposite edge of the beam. This can permit ions that are moving toward the accelerator, and that in the accelerator will end up being closest to the exit of the accelerator, to be removed. This can be accomplished without removing, or removing fewer of, ions that are moving in the direction away from the exit of the accelerator. Some embodiments of the applicant's teachings are hence directed to removing those ions located on one side of the beam only.

An alternative method of resolution improvement can apply to a single stage mirror. In a single stage mirror, ions in the accelerator with a velocity component in one direction only (positive or negative) along the TOF axis can be time focused better than if the ion beam contains a population of ions moving in both directions (positive and negative). Therefore, in some embodiments, it can be advantageous to direct the ion beam at a slight angle into the accelerator so the ions are all moving in the same direction relative to the TOF axis. This can allow better focusing by a single stage mirror, which provides cost-savings relative to a two-stage mirror.

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A mass spectrometer, comprising:

an accelerator having an inlet aperture through which an ion beam can be directed; and a masking element disposed upstream from the accelerator and configured to selectively block at least one of a central portion of the ion beam to block ions that share location but have different velocity independent of time wherein the blocking occurs without a pause and only one edge of the ion beam to block ions close to the accelerator exit, to improve peak shape, from entering the accelerator.

2. The mass spectrometer of claim 1, wherein the masking element is disposed within the inlet aperture of the accelerator.

3. The mass spectrometer of claim 1, wherein the masking element is disposed within beam-shaping optics disposed upstream from the accelerator.

4. The mass spectrometer of claim 1, wherein the portion of the ion beam comprises a portion of the ion beam located closest to an exit of said accelerator.

5. The mass spectrometer of claim 1, wherein the masking element comprises a wire electrode.

6. A method of directing an ion beam through a mass spectrometer, comprising:

directing the ion beam through a masking element disposed upstream of an accelerator, so as to selectively block at least one of a central portion of the ion beam to block ions that share location but have different velocity independent of time wherein the blocking occurs without a pause and only one edge of the ion beam to block ions close to the accelerator exit, to improve peak shape, from entering the accelerator.

7. The method of claim 6, wherein the portion of the beam is only one edge of the ion beam and said only one edge is blocked by an edge of an entrance slit of the accelerator.

* * * * *